US005297900A

United States Patent [19]

Witzand

[11] Patent Number: 5,297,900

[45] Date of Patent: Mar. 29, 1994

[54] ROCK STABILIZER

[76] Inventor: Hendrik H. Witzand, 13 Cedar Street, Langwarrin 3910 Victoria, Australia

[21] Appl. No.: 671,852

[22] PCT Filed: Sep. 29, 1989

[86] PCT No.: PCT/AU89/00419

§ 371 Date: Aug. 1, 1991

§ 102(e) Date: Aug. 1, 1991

[87] PCT Pub. No.: WO90/04085

PCT Pub. Date: Apr. 19, 1990

[30] Foreign Application Priority Data

Oct. 10, 1988 [AU] Australia ..... PJ0873

[51] Int. Cl.[5] ..... E21D 20/00

[52] U.S. Cl. ..... 405/259.3; 405/259.1; 411/521

[58] Field of Search ..... 405/259.3, 259.4–259.6, 405/259.1; 411/521

[56] References Cited

U.S. PATENT DOCUMENTS 4,260,294 4/1981 Cantrel .
4,284,379 8/1981 Chaiko ..... 405/259.3 X
4,407,610 10/1983 Elders .
4,472,087 9/1984 Elders .
4,502,818 3/1985 Elders ..... 405/259.3
4,636,115 1/1987 Davis et al. .

FOREIGN PATENT DOCUMENTS 56246 9/1980 Australia .
51667 1/1981 Australia .
68711 10/1981 Australia .
75054 3/1982 Australia .
3120809 12/1982 Fed. Rep. of Germany ... 405/259.3
2011567 7/1979 United Kingdom .

*Primary Examiner*—Dennis L. Taylor
*Attorney, Agent, or Firm*—Killworth, Gottman, Hagan & Schaeff

[57] ABSTRACT

A rock bolt is provided for insertion into a bore in the roof or side wall of an underground opening so as to stabilize the roof or wall of the opening. The rock bolt comprises a generally hollow elongate body having a side wall wherein the side wall has a flute formed from a pair of inwardly disposed wall portions interconnected at their respective inboard ends to form a hinge. The hinge is responsive to forces applied to and along the side wall by the bore so that the rock bolt may be deformed in the bore to accommodate stresses and strains placed upon the bolt during use without substantially weakening the strength of the bolt held in the bore.

9 Claims, 1 Drawing Sheet

ROCK STABILIZER

The present invention relates to rock stabilizers for use in stabilizing rock formations in mines, tunnels, and the like so as, for example, to make the working conditions in the mine or tunnel safer by providing greater stability for the rock formation. The rock stabilizer is also known under different names such as a rock-bolt, roof-bolt or under other similar names. In particular, the present invention relates to a rock stabilizer of a generally circular cross-section provided with a longitudinally extending deformity or interruption to its curved surface, such as for example a flute. More particularly, the present invention relates to an elongate tube of substantially circular cross-section having a flute, channel or groove extending more or less longitudinally along the entire length of the tube which is located in the side wall of the tube. The flute allows the diameter of the tube to vary within limits in accordance with the stresses and strains imposed thereon the-tube by the rock formation. Additionally, the present invention relates to methods of inserting the fluted stabilizer into earth structures, particularly into bores drilled in the walls of the tunnels, mines and other earth structures.

A particularly preferred form of the present invention relates to a rock stabilizer or rock-bolt in which a lengthwise extending flute is provided in the side wall of the tube which flute has a pair of opposed wall portions deformed inwardly toward the central axis of the tube, the opposed wall portions being joined together over their lengths so as to provide a hinge means to accommodate the changes in external diameter of the tube imposed by the stresses and strains of being tightly located in a bore in a rock formation.

Although the present invention will be described with particular reference to a rock stabilizer or rock-bolt having a flute acting as a hinge, it is to be noted that the scope of the present invention is not limited to the described embodiment but that the rock stabilizer of the present invention may take other forms and be used in other applications.

Rock bolts or stabilizers usually take the form of a solid cylinder or a hollow cylinder.

It is also known to have rock stabilizers of a form in which there is a longitudinally extending slot in the side wall of the hollow rock stabilizer (so-called slotted stabilizers) so that the generally circular cross-section of the stabilizer may be deformed slightly so as to adopt a number of varying diameters and/or configurations depending on the diameter of the bore into which it is received and on the compression forces applied to the stabilizer by the rock formation when received in the bore in use. However, in use of the stabilizers in many cases once the slotted stabilizers have been compressed to a relatively smaller diameter by the side walls being forced together when the compression forces are removed or the bore, because of ground movement, opens up slightly, the slotted stabilizer will not be able to radially expand to a longer diameter to fill the available space because it has been deformed beyond its elastic limit. Furthermore, it is to be noted that the movement of the earth is not constant over the length of the slotted stabilizer thus some parts of the bore within which the stabilizer is received will be of a larger diameter or size than other parts. In extreme cases the slotted stabilizer may De severed at one or more places over its length. Therefore, in many cases, the holding power of the slotted stabilizer is significantly reduced since it is not in full comparision over the entire length of the slotted stabilizer but rather is only in compression at those places where it is in intimate contact with the bore, where the bore has enlarged or the rock stabilizer broken there is only minimal holding power at best and at worst no holding power at all. In this case the earth or rock formation is not being reinforced and thus the chances of the earth or rock formation falling is significantly increased.

The present invention seeks to overcome this problem by providing a rock stabilizer having an integral hinge means formed in the side wall of the tube so that the rock stabilizer may adopt any diameter within reasonable limits within the bore and can accommodate more readily the movements of the ground, earth rock, etc., since the hinge means provides a restoring force to increase the diameter of the tube when the compression force of the rock formation is removed.

Therefore, it is an aim-of the present invention to provide a rock stabilizer or rock-bolt which at least alleviates one of the problems of previously available rock-bolts.

According to the present invention there is provided a rock stabilizer or rock-bolt for stabilizing a rock formation such as encountered in a mine shaft or tunnel comprising a generally hollow elongate tube of generally circular cross-section, said stabilizer having a wall which is provided with a flute means having two opposed side wall sections interconnected together so as to provide a hinge means in the side wall of the tube extending along the longitudinal axis of the tube over substantially the entire length of the tube, said flute being disposed inwardly so that the opposed side walls of the flute extend radially into the tube towards the central axis to form the hinge means for allowing the opposed wall portions of the flute to move relative to each other so as to vary the outside diameter of the tube when the stabilizer is received in a bore in use.

According to another aspect of the present invention there is provided an improved friction stabilizer, for installation in a bore of predetermined cross-sectional dimension which is formed in a structure such as a roof or side wall of a mine shaft or other underground opening, for anchoring said stabilizer in such bore to stabilize such roof or side wall structure, said stabilizer comprising a generally hollow elongate body having wall means having an outer surface for frictionally engaging the inner surface of the structure bore, said body further having a cross-sectional dimension which is greater than said predetermined dimension of such structure bore so as to require an insertion force to effect installation of said body into said bore, wherein said wall further has a flute means formed from a pair of inwardly disposed wall portions interconnected at their respective inboard ends to form a hinge means which is responsive to forces applied to and along said wall by the inner surface of such bore, upon said stabilizer having been forceably inserted thereinto, to cause a frictional engagement of said wall with the inner surface of such bore substantially along the full length thereof.

Typically, one end of the tube is provided with a tapered portion for facilitating entry of the tube into a bore drilled into a rock formation or similar. Typically, the tapered portion is a truncated conical section located at the forward end of the stabilizer in use. Typically, the flute means extends along the side wall of the truncated conical tip portion.

Typically, one end of the tube is provided with a fastening means for fastening roof plates or other fittings to the end of the tube. Typically, the fastening means comprises a ring fixedly secured to the end of the tube by welding or other similar means. Typically, the ring is discontinuous having a portion which is removed. Typically, the removed portion is aligned to correspond to the position of the flute in the side wall of the tube. In one embodiment the tube, ring and roof plate are formed integrally whereas in another embodiment the tube and ring are integral and the roof plate separate or in a still further embodiment, the tube, ring and roof plate are all separate components which can be assembled together into a single unit prior to use of the tube.

According to another aspect of the present invention there is provided a method of inserting a friction rock stabilizer into a bore formed in an earth structure, for stabilizing the structure, wherein the bore has a given transverse dimension, and the stabilizer has a first, free, relaxed, transverse dimension which is slightly greater than said given dimension of the bore and is resiliently contractible to a second, constrained, transverse dimension which is slightly less than said given dimension of said bore, said stabilizer having a side wall provided with a channel means extending longitudinally along the stabilizer defined by an opposed pair of wall segments interconnected at their respective distal ends located internally within the stabilizer forming a hinge means for providing a resilient bias of the stabilizer against the bore.

The present invention will now be described by way of example with reference to the accompanying drawings in which.

Figure 1:
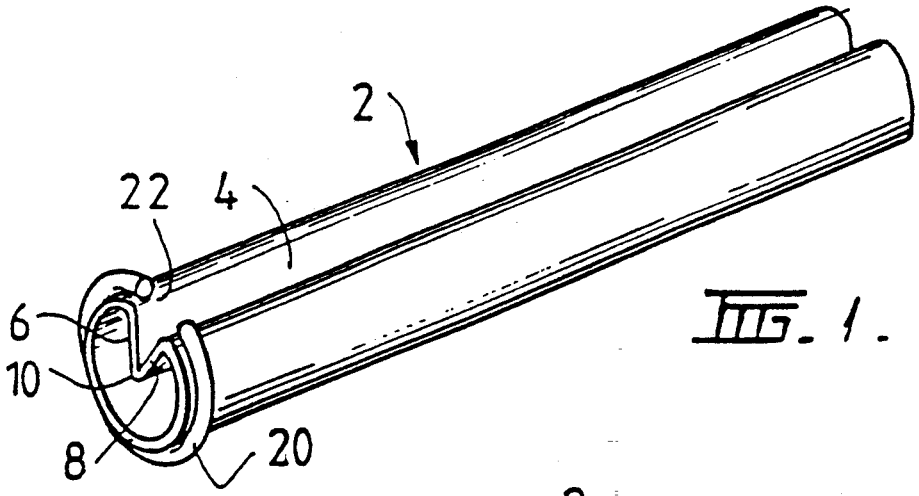
FIG. 1 is a perspective view of one end of one embodiment of the rock stabilizer.
Figure 2:
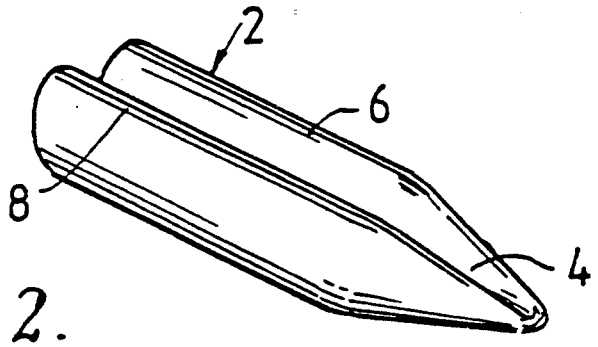
FIG. 2 is a perspective view of the other end of the embodiment of FIG. 1.
Figure 3:
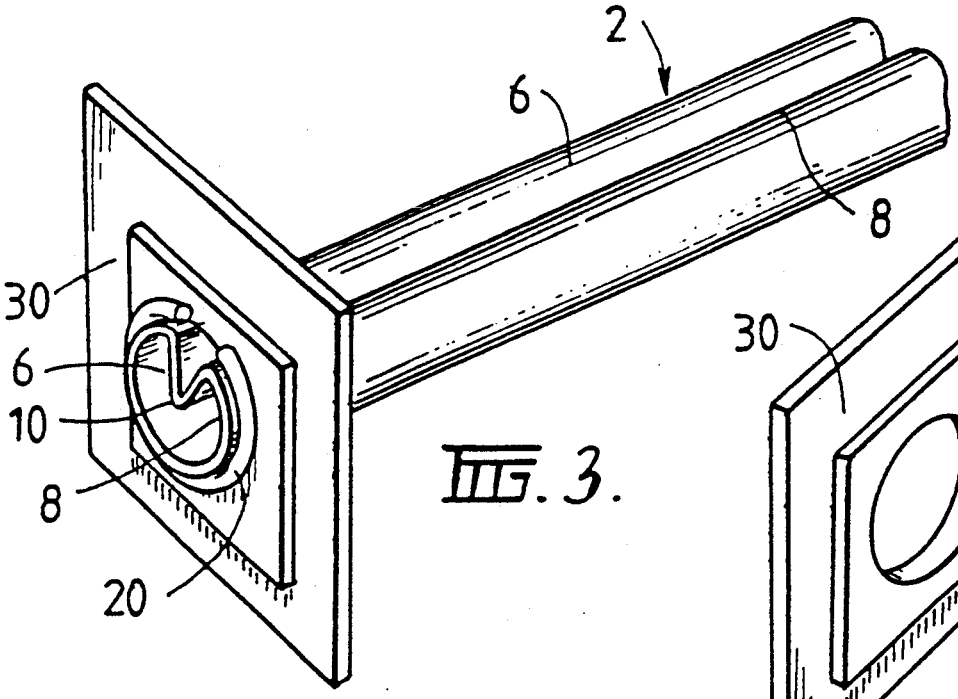
FIG. 3 is a perspective view of the first end of a second embodiment of the present invention provided with a roof plate.
Figure 4:
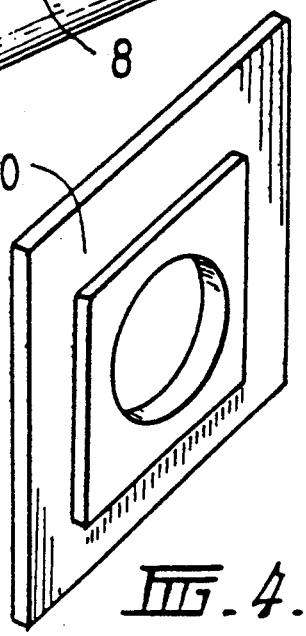
FIG. 4 is a perspective view of one form of the roof plate for use with the rock stabilizer of the present invention.

In FIGS. 1 and 2 there is shown a rock stabilizer according to the present invention generally denoted as 2. The rock stabilizer 2 is in the form of an elongate hollow circular cross-sectional tube having a flute 4 provided in the side wall of tube 2 extending along the lengthwise extending axis almost to the entire length of tube 2. It is to be noted that in some embodiments flute 4 may extend only partially along the entire length of tube 2.

Flute 4 comprises a pair of opposed wall portions 6, 8 joined together at their respective inboard ends 10 along the respective entire lengths. Join 10 is located internally within tube 2 and extends radially inwards towards the central axis of tube 2. Flute 4 acts as a hinge since opposed wall portions 6, 8 are able to deform or otherwise flex with respect to each other depending on the compressive loads applied radially to the rock stabilizer when in a bore in use. It is to be noted that wall portions 6, 8 are free to deform and flex in response to loads applied longitudinally and transversely to the tube as well as radially.

Flute 4 is typically formed integrally with tube 2 such as at the rolling stage of tube 2. The amount that flute 4 extends radially internally within tube 2 can vary from being almost as large as the diameter of the tube to..:being quite small depending upon the rock formation in which-it is to be used. Additionally, the radial extent of flute 4 may vary over its length.

Tube 2 is provided at one end with a fastening means, such as for example a fastening ring 20 which is securely attached to tube 2, such as by welding. In one embodiment ring 20 may be continuous to completely surround tube 2 whereas in another embodiment ring 20 is provided with a portion removed such as at location 22. If ring 20 is discontinuous, the omitted Dart is aligned with the position of flute 4 as shown in FIG. 1. It is to be noted that the end of tube 2 having ring 20 is not received in the bore of the rock formation but rather extends outwardly therefrom in use and accordingly there is no requirement for that end portion of tube 2 to be able to flex.

Roof plate 30 is fitted over tube 2 and is retained on tube 2 by ring 20. Roof plate 30 may take any suitable, convenient or desirable form. Roof plate 30 may be used to stabilize the rock formation into which the rock stabilizer is received or may be used to provide support for further stabilization such as a wire-net or wire-mesh or may be used as an attachment from which other fittings may be suspended such as for conveyors or the like.

The other end of tube 2 is typically tapered 14 in order to facilitate entry of the rock stabilizer into a bore in the earth structure requiring stabilization.. Typically, the tapered end 14 is a truncated conical section.

In operation, a bore is drilled in the roof of a mine shaft. The diameter of the bore is slightly smaller than the at-rest diameter of the rock stabilizer of the present invention. Tapered end 14 of tube 2 is inserted into the bore and the other end containing ring 20 is hammered to force tube 2 into the bore. Since the diameter of the bore is slightly less than the at rest diameter of tube 2 the walls of tube 2 are slightly compressed along join 10. The restoring force provided by the hinge means formed by the flute 4 holds tube 2 in the bore. If due to movement in the rock formation, the diameter of the bore increases, the resilient bias provided by the flute forces the side walls of tube 2 to expand against the walls of the bore to securely anchor tube 2 in the bore. On the other hand, if the diameter of the bore decreases the flute means allows the tube to be compressed which means that the stabilizer does not fracture in the bore and may still reinforce the earth formation.

The described arrangement has been advanced by explanation and many modifications may be made without departing from the scope of the invention which includes every novel feature and novel combinations of features hereindisclosed.

One modification is to have two or more flutes arranged around the wall of the tube. The two or more flutes may be arranged in any pattern around the walls.

A further modification is that the flute may taken any configuration or shape.

Those skilled in the art will appreciate that the invention described herein is susceptible to variations and modifications other than those specifically described. It is understood that the invention includes all such variations and modifications which fall within its spirit and scope.

I claim:

1. A stabilizer for stabilizing earth, rock or other structures, said stabilizer comprising a generally hollow elongate body in which a portion of the wall forming said body is provided with a flute means for hinging, said body defining a tube having a generally circular cross-section and said wall forming said body being continuous, said flute means including two opposed side wall portions interconnected together at their respective inboard edges, said two opposed side wall portions extending generally parallel to the longitudinal axis of said body over substantially the entire length of said body and extending generally radially inwardly into said body to substantially the central axis thereof, said opposed side wall portions being capable of moving relative to each other so as to vary the outside diameter of said body when said body is received in a bore in use.

2. A stabilizer according to claim 1 in which a first end of said body is tapered in order to facilitate entry of said body into a bore.

3. A stabilizer according to claim 1 further comprising a fastening means for retaining fittings to a second end of said body.

4. A stabilizer according to claim 3 in which said fastening means comprises a ring fixedly secured to said second end of said body.

5. A stabilizer according to claim 4 in which said ring is discontinuous and the discontinuity of the ring is in register with said flute means.

6. A stabilizer according to claim 3 further comprising at least one fitting, said at least one fitting comprising a roof plate.

7. A stabilizer according to claim 3 wherein said fastening means comprises a ring integrally formed with a fitting.

8. A stabilizer according to claim 1 wherein said flute means substantially forms a "V" shape in cross-section.

9. A stabilizer as recited in claim 1, wherein said body has a closed tapered end in order to facilitate entry of said body into a bore.

* * * * *